US005758369A

United States Patent [19]

Takahashi et al.

[11] Patent Number: 5,758,369

[45] Date of Patent: Jun. 2, 1998

[54] BATHTUB HAVING BATH WATER ACTIVATING APPARATUS

[76] Inventors: Kenzo Takahashi, 9-149, Rokkodai, Matsudo-Shi, Chiba-Ken; Hiroyasu Nitta, 24-14, Minami-Oi 6-Chome, Shinagawa-Ku, Tokyo-To, both of Japan

[21] Appl. No.: 864,003

[22] Filed: May 27, 1997

Related U.S. Application Data

[63] Continuation of Ser. No. 400,836, Mar. 8, 1995, abandoned.

[30] Foreign Application Priority Data

Mar. 9, 1994 [JP] Japan ..... 6-038279

[51] Int. Cl.[6] ..... E04H 4/00

[52] U.S. Cl. ..... 4/488; 4/904; 4/496

[58] Field of Search ..... 4/488, 492, 496, 4/506, 507, 509, 513, 539, 541.1, 904

[56] References Cited

U.S. PATENT DOCUMENTS

| | | | |
|---|---|---|---|
| 520,342 | 5/1894 | Sutro | 4/904 |
| 1,432,351 | 10/1922 | McGahan | 210/284 |
| 2,035,835 | 3/1936 | Raber | 4/904 |
| 3,841,486 | 10/1974 | Heitmann et al. | 210/222 X |
| 4,903,352 | 2/1990 | Murakami | 4/492 X |
| 5,006,245 | 4/1991 | Yukishita | 210/256 |

FOREIGN PATENT DOCUMENTS

| | | | |
|---|---|---|---|
| 0195237 | 8/1986 | Japan | 4/541.1 |

*Primary Examiner*—Robert M. Fetsuga
*Attorney, Agent, or Firm*—Ladas & Parry

[57] ABSTRACT

A bathtub comprises: a tub body (1) for accumulating bath water; a bath water treating section for activating the bath water; and a water circulating section (2) for forcedly circulating the bath water between the tub body and the bath water treating section. The bath water treating section is a magnetic water treating section (3) and/or a ceramic ball water treating section (4) to activate the bath water in a wide range.

5 Claims, 7 Drawing Sheets

BATHTUB HAVING BATH WATER ACTIVATING APPARATUS

This is a continuation of application Ser. No. 08/400,836 filed on Mar. 8, 1995 abandoned.

FIELD OF THE INVENTION

The present invention relates to a bathtub having a bath water activating apparatus, and more specifically to a bathtub provided with such an apparatus for activating bath water by use of magnetism or ceramic balls.

BACKGROUND OF THE INVENTION

Conventionally, there are known various bathtubs of static water type, flowing water type (referred to as a jet bath), infrared radiation type (an apparatus for radiating extreme infrared rays is disposed at the bottom of the tub), etc.

In the conventional bathtubs, however, water is only forcedly circulated. In the case of the bathtub of the infrared radiation type, since only a water circulating apparatus is simply incorporated with the infrared ray radiating apparatus and further the wave lengths of the generated extreme infrared rays lie within a very narrow range from 4 to 8 μm, there exists a problem in that bath water is soiled or not activated sufficiently.

SUMMARY OF THE INVENTION

With these problems in mind therefore, it is the object of the present invention to provide a bathtub of water flowing type which can activate bath water effectively.

To achieve the above mentioned object, the present invention provides a bathtub for activating bath water comprising a tub body for accumulating bath water; a bath water treating section comprising activating means for activating bath water accumulated in said tub body; and a water circulating section comprising water circulating means for forcedly circulating the bath water between said tub body and said bath water treating Section. The activating means includes magnetic water treating means for magnetically activating the bath water circulated by said water circulating means and ceramic ball means including a plurality of ceramic balls in a path of the bath water circulated by said water circulating means for activating the bath water flowing between the plurality of ceramic balls. The magnetic water treating means comprises a plurality of magnetic plates spaced at regular intervals with a first of the magnetic plates having a magnetic pole that opposes and is different than a magnetic pole of a second magnetic plate such that magnetic force lines pass from said first magnetic plate to said second magnetic plate. The water circulating means causes the bath water to flow through a space between the first and second magnetic plates substantially at a right angle to the magnetic force lines so that the bath water is treated magnetically.

Further, the tub body is of double structure having an inner hollow treatment space therein. The bath water treating section is disposed within the inner hollow treatment space.

Further, the magnetic water treating section comprises a plurality of magnetic plates arranged at regular intervals by opposing two different magnetic poles of the magnetic plates to each other.

Further, the ceramic ball water treating section comprises a plurality of ceramic balls arranged within a box-shaped vessel formed with slits for flowing the bath water there into on one side thereof and with other slits for flowing the bath water therefrom on the other side thereof.

The ceramic balls are formed of soft porous ancient oceanic humus stones.

Further, the tub body is formed into a roughly disk-shape, and a plurality of units each composed of said bath water treating section and said water circulating section are arranged radially in said tub.

In the bathtub according to the present invention, water is accumulated in the tub body and circulated forcedly by the water circulating section between the tub body and the bath water treating section magnetically or by use of ceramic balls to activate the bath water.

Further, in the tub body is formed into double structure having a hollow treatment chamber. The magnetic water treating section and/or the ceramic ball water treating section are disposed in the hollow treatment chamber. The bath water is treated to activate the bath water, when passed through the treatment chamber, by the magnetic water treating section and/or the ceramic ball water treating section.

DETAILED DESCRIPTION OF THE EMBODIMENTS

Figure 1:
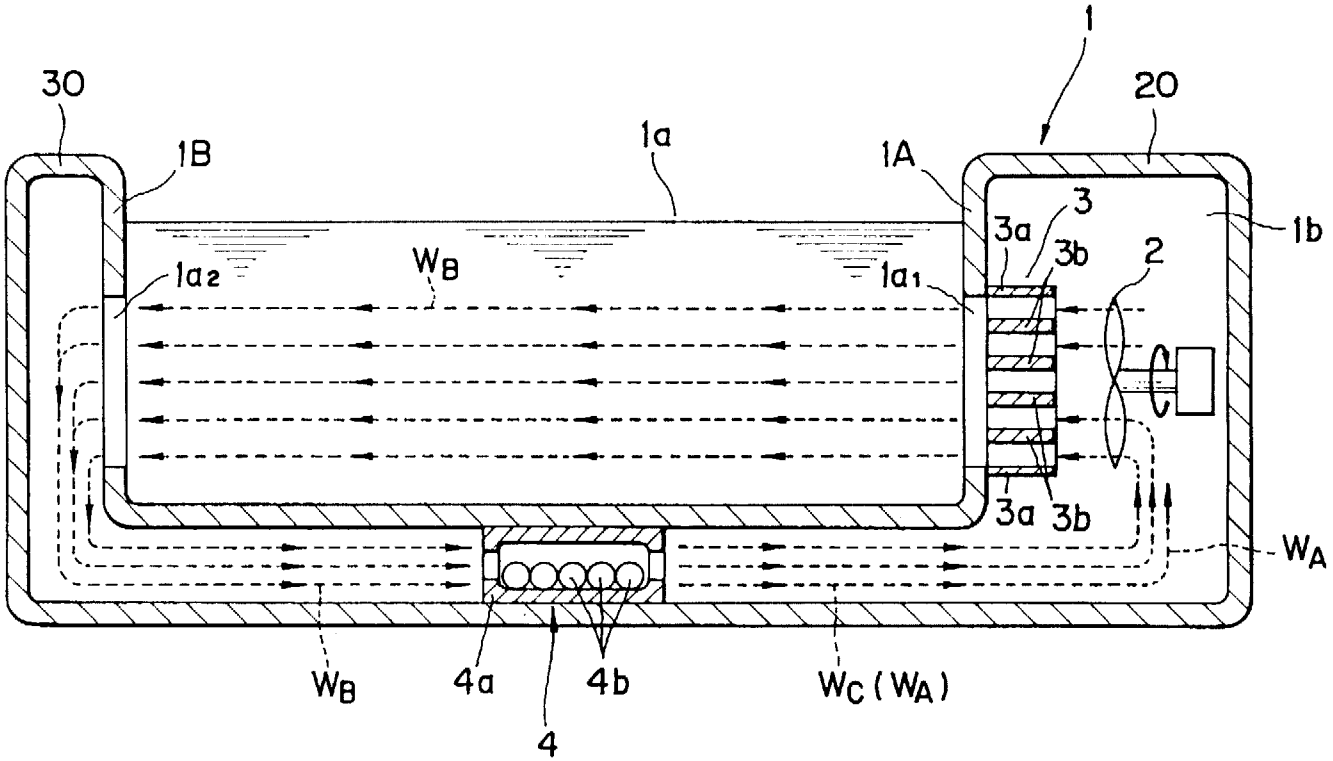
FIG. 1 is a cross-sectional view showing a first embodiment of the bathtub according to the present invention, which is taken along the line I—I in FIG. 2.
Figure 2:
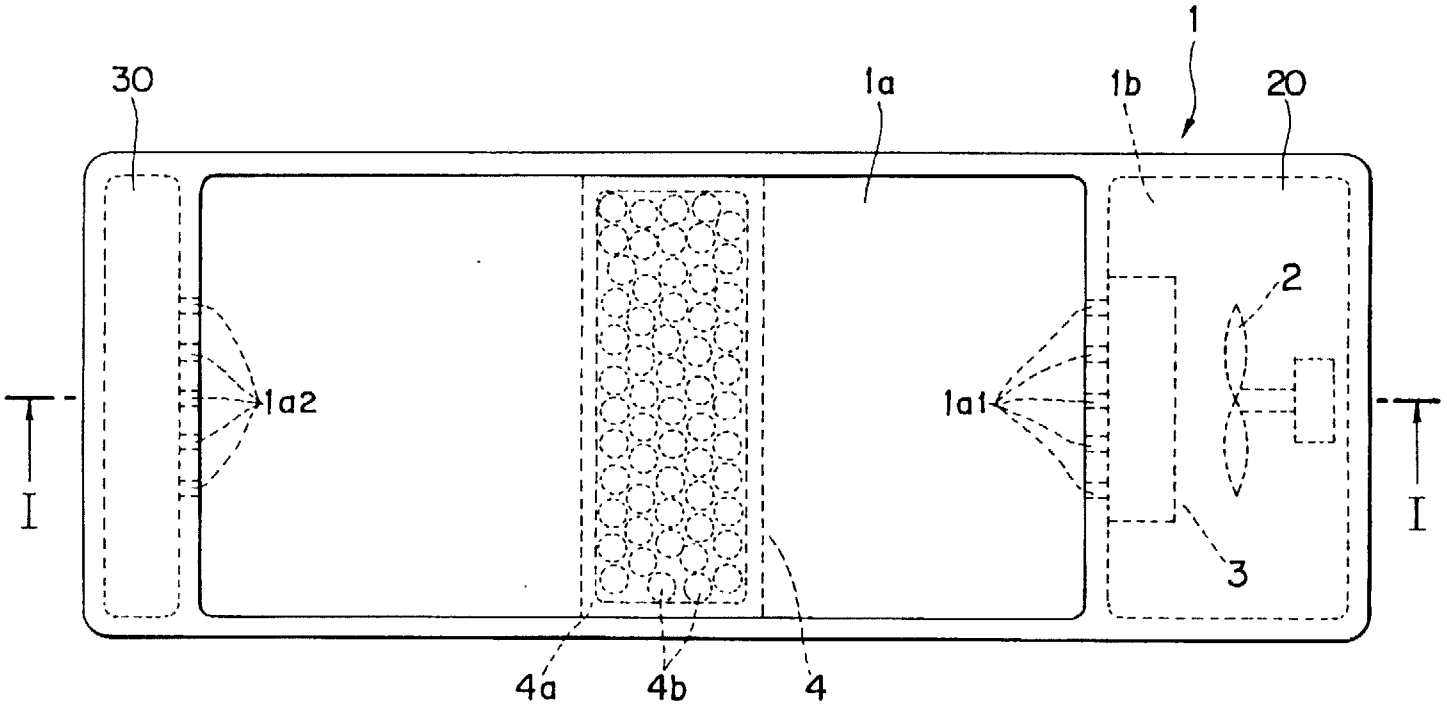
FIG. 2 is a plane view showing the same first embodiment.

FIG. 2 shows a first embodiment of the bathtub according to the present invention. FIG. 1 is a cross-sectional view taken along the line I—I in FIG. 2. The bathtub according to the present invention is provided with a function for activating bath water. For water activation, bath water is forcedly circulated in the arrow directions in FIG. 1, and the forcedly circulated bath water is treated through both magnetism and ceramic balls.

In more detail, a bath body 1 accumulates bath water. The bath water in the bath body 1 is forcedly circulated with a screw 2 driven by a motor (a water circulating section) by way of a magnetic water treating section 3, a tub 1*a*, a ceramic ball water treating section 4 and again the magnetic water treating section 3. During the forced circulation, bath water is activated by the magnetic field of the magnetic water treating section 3 and the ceramic balls of the ceramic ball water treating section 4.

The function of the bathtub body according to the present invention will be explained in further detail hereinbelow.

In this specification, a terminology "water activation" is often used. "Water activation" implies that water cluster (a molecular group composed of 10 to 15 molecules coupled by hydrogen couplings on the basis of attractive forces generating between hydrogen elements of a water molecule and an oxygen element of another water molecule) changes to a smaller cluster by various energy (e.g., electromagnetic waves).

The tub body 1 is made of an non-magnetic material such as plastic. As understood with reference to FIG. 1, the tub body 1 is of hollow double-structure, which is composed of a tub section 1*a* and an inner hollow portion 1*b*. The bath water treating section is disposed in the inner hollow portion 1*b*. Further, a plurality of vertical slits 1*a*1 are formed in a vertical wall 1A of the tub body 1 in parallel to each other, and a plurality of other vertical slits 1*a*2 are formed in another vertical wall 1B of the tub body 1 in parallel to each other. The two vertical walls 1A and 1B are opposed to each other, and the tub portion 1*a* communicates with the treatment section 1*b* through these slits 1*a*1 and 1*a*2. As shown in FIGS. 1 and 2, bath water in the treatment section 1*b* flows into the tub section 1*a*, by the screw 2 driven by the motor, through the vertical slits 1*a*1 formed in the vertical wall 1A in the arrow direction, and further flows into the treatment section 1*b* through the vertical slits 1*a*2 formed in the vertical wall 1B in the arrow direction in FIG. 1, so that bath water can be circulated between the tub section 1*a* and the treatment section 1*b*. It is preferable to set the flowing speed of bath water to 1.5 m/sec or higher, from the standpoint of activation treatment by the magnetic water treating section 3, as described later in detail. Further, it is particularly preferable to set the flowing speed to 4 m/sec or higher.

Figure 3:
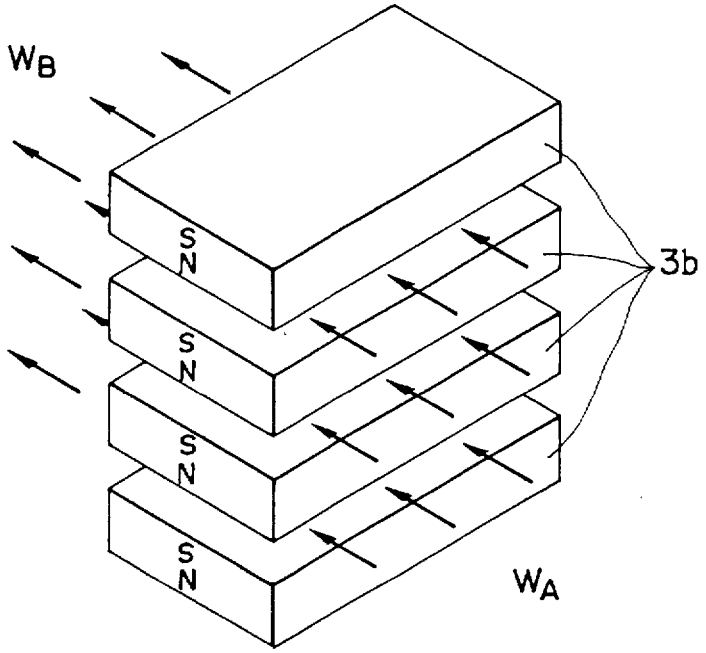
FIG. 3 is a perspective view showing an essential portion of the magnetic water treating section.

As shown in FIG. 1, the treatment section 1*b* includes the magnetic water treating section 3 and the ceramic ball water treating section 4. The magnetic water treating section 3 is disposed in contact with the upstream side slits 1*a*1 formed in the vertical wall 1A. As understood by FIGS. 1 and 3, in this magnetic water treating section 3, a plurality of flat magnetic plates 3*b* are arranged at regular intervals in the vertical direction (as a shelf) within a stainless frame 3*a* (not shown in FIG. 3 but shown in FIG. 1). The magnetic plates 3*b* are arranged in such a way that two different poles thereof are opposed to each other in the vertical direction and thereby a pseudo-closed magnetic circuit through which magnetic force lines ML pass can be formed. In the closed magnetic circuit, it is possible to effectively prevent magnetic flux from being leaked to the outside. Further, the magnetic field distribution between the magnetic plates 3*b* is uniform and the magnetic intensity thereof is 0.2 T or higher. This magnetic strength is necessary to treat bath water magnetically. Further, it is preferable that the magnetic intensity is 0.2 to 0.9 T, further 0.35 to 0.45 T, and further 0.4 T or higher.

Figure 4:
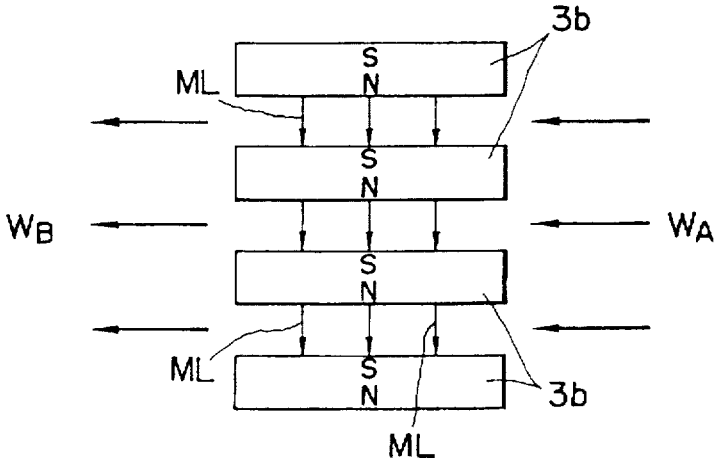
FIG. 4 is an illustration showing the magnetic field of the magnetic water treating section.

As shown in FIG. 4, bath water $W_A$ is passed between the magnetic plates 3*b* under magnetic treatment, and changed to bath water $W_B$ In other words, when bath water $W_A$ crosses the magnetic lines ML, the bath water $W_A$ is magnetically treated and thereby activated to the bath water $W_B$. The magnetically treated bath water $W_B$ flows into the tub section 1*a*. The bath water $W_B$ flowing into the tub section 1*a* is passed through the downstream slits 1*a*2 and further flows into the ceramic ball water treating section 4 disposed at the bottom of the tub section 1*b*.

Figure 5:
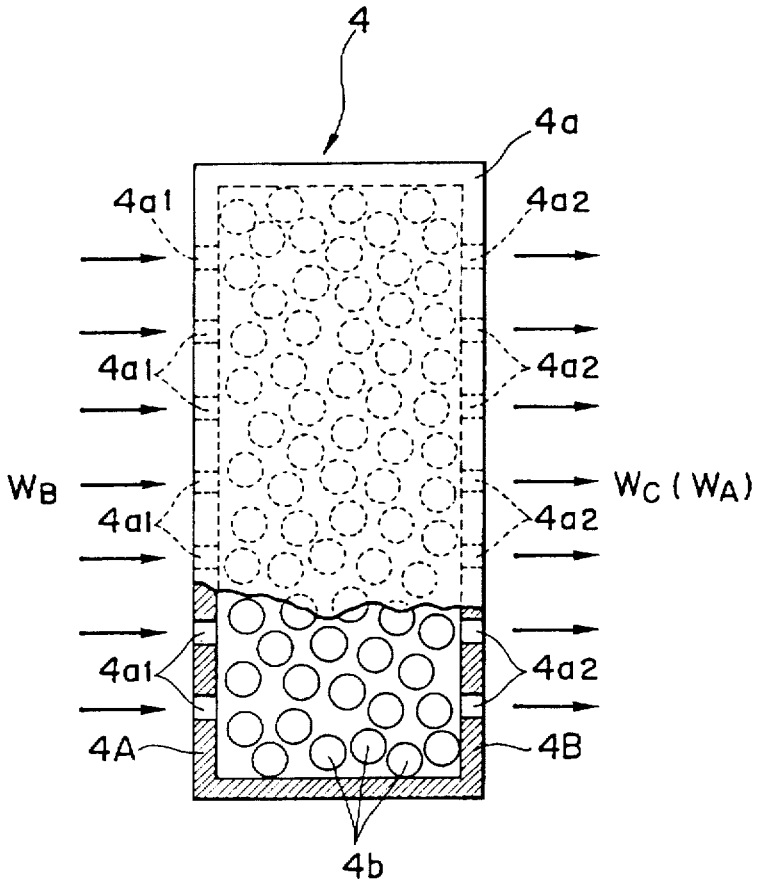
FIG. 5 is an enlarged view showing the ceramic ball water treating section.

As understood with reference to FIGS. 1, 2 and 5, a plurality of ceramic balls 4*b* are arranged in a box-shaped vessel 4*a*. A plurality of slits 4*a*1 and 4*a*2 are formed in a pair of opposing walls 4A and 4B of the box-shaped vessel 4*a*, respectively. Therefore, bath water $W_B$ forcedly circulated flows into the vessel 4*b* through the slits 4*a*1, passing around the ceramic balls 4*b* for activation, and then flows to the outside of the vessel 4*b* through the slits 4*a*2 as bath water $W_C$. The ceramic ball water treating section 4 activates the bath water not activated by the magnetic water treating section 3 in a range different from the magnetic water treating section 3.

The bath water $W_C$ flowing out of the ceramic ball water treating section 4 is fed again to the magnetic water treating section 3 for the same magnetic treatment.

The ceramic ball 4*b* is constructed by fixing pulverized stone. The pulverized stone (raw ore) is natural stone produced naturally, which is referred to as soft porous ancient oceanic humus stone. The stone is constructed by the embedding and accumulation (caused by the movements of the earth's crust) of various nektons (shells, fishes), plankton, seaweed, marine plants, living things, etc. all composed of animal mineral fossil bodies (silicic acid), during the time passage of millions of years (15 to 20 million years). These ceramic balls are now on the market by Trade Mark "Minestrome" by SAPONI Laboratory, (Limited Responsibility Company). The stone referred to as soft porous ancient humus stone is a multi-element mineral composed of many (24 to 25) different elements. The major elements thereof are silicic acid, lime, iron oxide, magnesium, kalium, aluminum, manganese, sulfur, sodium, titanium, copper, zinc, nickel cobalt, phosphoric acid, other minute elements. The raw ore of the soft porous ancient oceanic humus stone is mixed with water and formed into a spherical shape with a diameter of about 16 mm. The formed spherical raw ore is heated at about 1300° C. for about a half day into ceramics, and further cooled gradually for a half day. The ceramic balls 4*b* can be obtained as described above.

In the bathtub according to the present invention, bath water can be activated magnetically when passing through the magnetic water treating section 3. To increase the efficiency of this treatment, the bath water is fed at the water flow speed higher than 4 m/sec by the screw 2 driven by a motor, and the intensity of the magnetic field generated by the magnetic water treating section 3 is determined 0.4 T or higher. Further, the magnetic field is generated so as to distribute highly uniformly. Under these conditions, bath water passed through the magnetic water treating section 3 can be efficiently ionized, so that the cluster (molecular group) can be reduced and thereby water can be activated. Further, the bath water is further activated by the ceramic ball water treating section 4 in a ceramic ball activation range different from the magnetic activation range. Accordingly, it is possible to activate bath water in a wide range by use of both the magnetic water treating section 3 and the ceramic ball water treating section 4 in combination.

Figure 6:
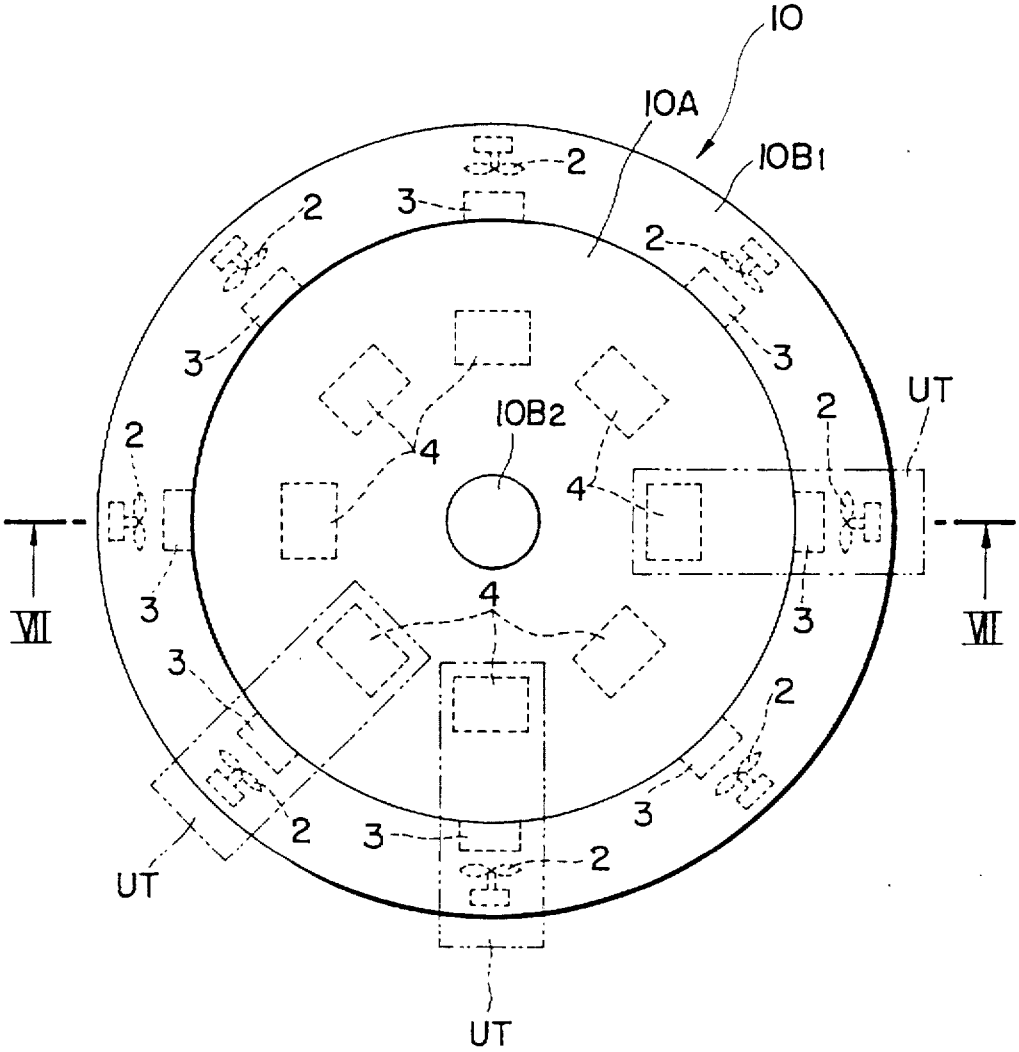
FIG. 6 is a plane view showing a second embodiment of the present invention.
Figure 7:
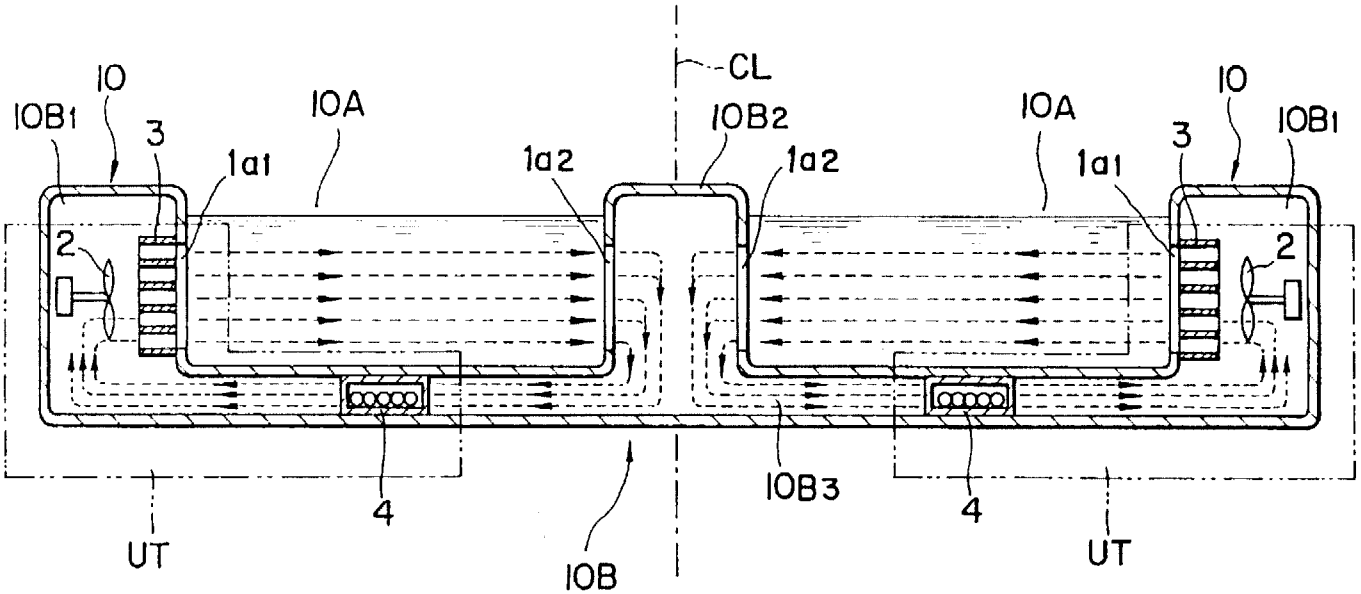
FIG. 7 is a cross-sectional view showing the same second embodiment, taken along the line VII—VII in FIG. 6.

FIGS. 6 and 7 show a second embodiment of the present invention. FIG. 6 is a plan view thereof, and FIG. 7 is a cross-sectional view taken along the line VII—VII in FIG. 6. The bathtub of this embodiment is circular in shape and a plurality of units UT each composed of the screw 2 driven by a motor, the magnetic water treating section 3 and the ceramic ball water treating section 4 are arranged radially. In more detail, the tub body 10 is constructed into annular hollow double-structure which is composed of a treatment chamber 10B and an annular recessed tub 10A. The treatment chamber 10B is composed of a central hollow treatment chamber 10B2, an outer annular hollow treatment chamber 10B1, and a bottom circular hollow treatment chamber 10B3. In the treatment chamber 10B, the treatment units UT (the screw 2 with a motor, the magnetic water treating section 3 and the ceramic ball water treating section 4) are arranged. Further, as shown in FIG. 7, these treatment units UT are arranged symmetrically with respect to the central line CL. Further, the arrangement of the treatment unit UT shown on the right side in FIG. 7 is basically the same as the construction shown in FIG. 1. Therefore, the same reference numerals have been retained for the similar parts which have the same functions as with the case of the first embodiment, without repeating the similar description thereof.

Figure 8:
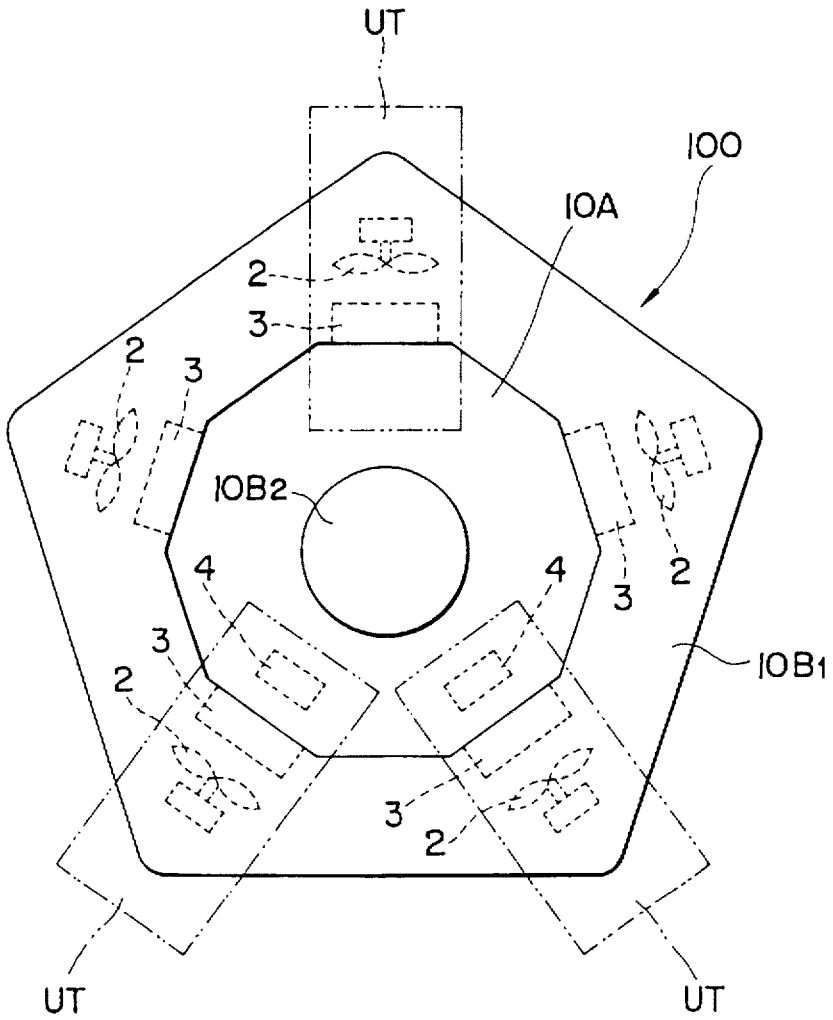
FIG. 8 is a plane view showing a third embodiment of the present invention.

FIG. 8 shows a third embodiment of the present invention, which is a modification of the second embodiment. The shape of the bathtub of this third embodiment is pentagonal. The construction other than the above is basically the same as the second embodiment. Therefore, the same reference numerals have been retained for the similar parts which have the same functions as with the case of the first embodiment, without repeating the similar description thereof.

In the bathtub according to the present invention, since bath water is treated by magnetism and/or ceramic balls, it is possible to activate bath water in a wide activation range. In addition, since water is circulated forcedly, it is also possible to obtain massage effect. Owing to the activation of bath water in a wide activation range, it is possible to remove the water dirt such as fur produced in the bath water. In addition, bath water can be sterilized and further bleaching power swell can be reduced or removed, thus providing a soft water. Further, as the bathing effect, metabolism can be made active; fatigue of the whole body can be reduced; skin roughness can be prevented; allergy dermatitis can be suppressed;

excessive fat can be removed; etc.

Further, the bathtub is formed into a unit type in such a way that the circulating section, the magnetic water treating section, and the ceramic ball water treating section are all arranged in a hollow treatment chamber formed in the bathtub body. Therefore, the bathtub can be compacted, and further assembled as a single unit all in the same factory, so that the delivery lead time of the bathtub can be reduced.

As described above, in the bathtub according to the present invention, bath water can be activated magnetically by the magnetic water treating section. Further, bath water can be activated by the ceramic ball water treating section. As a result, bath water can be treated and activated more effectively by the synergistic effects of both the magnetism and the ceramic balls. Further, since the tub is constructed into double structure, the magnetic and ceramic ball water treating sections can be housed simply by forming a hollow portion in the conventional bathtub, so that the bathtub can be manufactured into a small shape and at a low cost.

What is claimed is:

1. A bathtub which comprises a tub body (1) of double structure formed with a tub (1*a*) for accumulating bath water and with an inner hollow treating chamber (1*b*), said tub body (1) having a pair of vertical walls (1A, 1B) arranged in longitudinal direction of the tub (1*a*) so as to be opposed to each other with the tub disposed between the two vertical walls, one (1A) of the vertical walls being formed with slits ($1a_1$) and the other (1B) of the vertical walls being formed with other slits ($1a_2$), these slits ($1a_1$, $1a_2$) being extended vertically and arranged horizontally, the tub (1*a*) and the inner hollow treating chamber (1*b*) communicating with each other circulatively through those slits ($1a_1$, $1a_2$) so as to form a water circulating flow path, the inner hollow treating chamber (1*b*) being formed with two vertical hollow portions communicating with the tub (1*a*) through these slits ($1a_1$, $1a_2$) formed in the two opposed vertical walls (1A, 1B) respectively and further with a bottom inner hollow portion formed under the tub (1*a*), the water circulating flow path being formed by the two vertical hollow portions and the bottom hollow portion of the inner hollow treating chamber (1*b*);

a water circulating section (2) for forcedly circulating the bath water filling the tub (1*a*) and the inner hollow treating chamber (1*b*) along the water circulating flow path at a water flow rate of 1.5 to 4.0 m/sec, the circulated bath water flowing from the treating chamber (1*b*) into the tub (1*a*) through the slits ($1a_1$) formed in the vertical wall (1A), crossing the tub (1*a*), and flowing into the treating chamber (1*b*) through the slits ($1a_2$) formed in the other vertical wall (1B);

a magnetic treating section (3) disposed within the treating chamber (1*b*) and mounted on one (1A) of the vertical walls, said magnetic treating section (3) being composed of a plurality of roughly horizontal magnetic plates (3*b*) each having a predetermined width and arranged roughly horizontally with a predetermined gap between the two, the formed gaps and the slits ($1a_1$) being at right angle to each other, magnetic force lines of a magnetic field intensity of 0.2 T to 0.9 T being formed between the plates (3*b*), the bath water being treated magnetically when circulated through the magnetic gaps so as to cross the magnetic field lines, the magnetically treated bath water being passed into the tub (1*a*) through the slits ($1a_1$) formed on the vertical wall (1A); and a ceramic ball treating section (4) disposed below a bottom plate of the tub (1*a*) within the treating chamber (1*b*) and midway of the water circulating flow path to accumulate ceramic balls (4*b*) in a box-shaped vessel (4*a*), the box-shaped vessel having one side wall (4A) formed with slits ($4a_1$) for flowing the circulating bath water from the treating chamber (1*b*) thereinto and another side wall (4B) formed with other slits ($4a_2$) for flowing the bath water treated through the ceramic balls (4*b*) into the treating chamber (1*b*), these slits ($4a_1$, $4a_2$) being formed in the two side walls (4A, 4B), respectively at regular intervals and arranged at least in width direction of the walls (4A, 4B), the ceramic balls being formed of soft porous ancient oceanic humus stones.

2. A bathtub having a tub body (10) of roughly hollow vessel, a plurality of magnetic treating sections (3), a plurality of water circulating sections (2), and a plurality of ceramic ball treating sections (4) all assembled with the tub body, one of a plurality of water treating units being constructed by a part of the tub body (10), one of the magnetic treating sections (3), one of the water circulating sections (2), and one of the ceramic ball treating sections (4) respectively, wherein:

the tub body (10) is formed with a central hollow cylindrical treating chamber (10B2), a circumferential annular hollow treating chamber (10B1), an annular recessed tub (10A) formed between the central and circumferential hollow treating chambers (10B2, 10B1) and a circular bottom hollow treating chamber (10B3), each said water treating unit being constructed by one of said water circulating sections (2) and one of magnetic treating sections (3) both disposed at a part of the circumferential annular hollow treating chamber (10B1) respectively, and one of sade ceramic ball treating sections (4) disposed at least a part of the circular bottom hollow treating chamber (10B3);

each of the water circulating sections (2) forcedly circulates part of bath water filling the annular recessed tub (10A) and the treating chambers (10B1–10b3) along a water circulating water flow path such that water flows from part of the circumferential annular hollow treating chamber (10B1) into the central hollow treating chamber (10B2) radially through a part of the tub (10A) and further returns to the circumferential annular treating chamber (10B1) radially through a part of the circular bottom hollow treating chamber (10B3) at a water circulating flow rate of 1.5 to 4.0 m/sec, through slits ($1a_1$) formed at a part of an inner wall of the circumferential annular hollow treating chamber (10B1) and opposing silts ($1a_2$) formed in a part of a wall of the central hollow treating chamber (10B2), these slits ($1a_1$, $1a_2$) being extended vertically and arranged horizontally;

each of the magnetic treating sections (3) is mounted on an inner wall surface of the circumferential annular hollow treating chamber (10B1), each magnetic treating section (3) being composed of a plurality of roughly horizontal magnetic plates each having a predetermined width and arranged roughly horizontally with a predetermined gap between the two, the formed magnetic gaps and the slits ($1a_1$) being at right angle to each other, magnetic force lines of a magnetic field intensity of 0.2 T to 0.9 T being formed between the plates (3*b*), the bath water being treated magnetically when circulated through the magnetic gaps so as to cross the magnetic field lines, the magnetically treated bath water flowing into the tub (10A) through the slits ($1a_1$) formed on the inner wall surface of the circumferential annular hollow treating chamber (10B1); and each of the ceramic ball treating section (4) is disposed below a bottom plate of the tub (10A) within the circular bottom hollow treating chamber (10B3) and midway of the water circulating flow path to accumulate ceramic balls (4*b*) in a box-shaped vessel (4*a*), the box-shaped vessel having one side wall (4A) formed with slits ($4a_1$) for flowing the circulating bath water from the central hollow cylindrical treating chamber (10B2) thereinto and another side wall (4B) formed with other slits ($4a_2$) for flowing the bath water treated through the ceramic balls (4*b*) into the circumferential annular hollow treating chamber (10B1), these slits ($4a_1$, $4a_2$) being formed in the two side walls (4A, 4B), respectively at regular intervals and arranged at least in width direction of the walls (4A, 4B), the ceramic balls being formed of soft porous ancient oceanic humus stones.

3. The bathtub of claim 2, wherein the number of the water treating units is two, and the two water treating units being arranged radially and opposingly to each other.

4. The bathtub of claim 2, wherein the number of the water treating units is five.

5. The bathtub of claim 2, wherein the number of the water treating units is six.

* * * * *